US007434710B2

(12) United States Patent
Spriegel

(10) Patent No.: US 7,434,710 B2
(45) Date of Patent: Oct. 14, 2008

(54) BELLOWS PUMP MECHANISM

(75) Inventor: Andrew R. Spriegel, Massillon, OH (US)

(73) Assignee: Joseph S. Kanfer, Richfield, OH (US)

( * ) Notice: Subject to any disclaimer, the term of this patent is extended or adjusted under 35 U.S.C. 154(b) by 520 days.

(21) Appl. No.: 11/287,528

(22) Filed: Nov. 23, 2005

(65) Prior Publication Data

US 2007/0114247 A1 May 24, 2007

(51) Int. Cl.
*B65D 37/00* (2006.01)

(52) U.S. Cl. ..... 222/207; 92/36; 417/472

(58) Field of Classification Search ..... 222/207; 92/36, 34; 417/472

See application file for complete search history.

(56) References Cited

U.S. PATENT DOCUMENTS

| | | | | |
|---|---|---|---|---|
| 3,777,941 | A | 12/1973 | Riddle | 222/207 |
| 3,820,689 | A | 6/1974 | Cocita | 222/207 |
| 3,987,938 | A | 10/1976 | Cooprider et al. | 222/209 |
| 5,099,885 | A | 3/1992 | Nilsson | 137/852 |
| 5,176,510 | A | 1/1993 | Nilsson | 417/479 |
| 5,452,826 | A | 9/1995 | Stern | 222/207 |
| 6,216,916 | B1 | 4/2001 | Maddox | 222/105 |
| 6,752,295 | B2 * | 6/2004 | Weber | 222/209 |
| 7,025,233 | B2 * | 4/2006 | Masuda | 222/321.9 |

FOREIGN PATENT DOCUMENTS

| | | |
|---|---|---|
| EP | 0549050 | 6/1993 |

* cited by examiner

*Primary Examiner*—Kevin P. Shaver
*Assistant Examiner*—Hyea J Choi
(74) *Attorney, Agent, or Firm*—Rener, Kenner, Greive, Bobak, Taylor & Weber

(57) ABSTRACT

A bellows-type pump includes a body portion with an inlet and an outlet. A bellows member is secured to the body portion and provides a dosage volume that communicates with both the inlet and outlet. Compressing the bellows member causes a sealing web thereof to contact the inlet and seal the same against the flow of product from within the dosage volume. The sealing web does not cover the outlet upon compression of the bellows member and, thus, product is dispensed through the outlet upon such compression. Expansion of the bellows member draws product in through the inlet.

6 Claims, 4 Drawing Sheets

BELLOWS PUMP MECHANISM

TECHNICAL FIELD

The present invention generally relates to pump mechanisms. More particularly, the present invention relates to pump mechanisms that are employed in dispensers, most often wall-mounted dispensers for soap and other hand-treatment products.

BACKGROUND OF THE INVENTION

Wall-mounted dispensers for fluid or flowable products are well known in the art. These generally consist of a wall-mounted cabinet with a chamber for receipt of refills containing the flowable product. A dispenser base is mounted on a wall or counter top and a cover is usually hinged to the dispenser base to provide access to the interior. The dispenser base includes various types of receptacles or shelves designed to support and position a cartridge, bag or box that contains the product to be dispensed. These cartridges, bags, boxes, etc., are replaceable so that the dispenser can be refilled when the product supply is exhausted.

These cartridges or refills take various shapes and forms in the prior art. Perhaps the most common currently used are combination bag and pump arrangements that include a collapsible bag containing the flowable product, and a pump mechanism affixed to the bag and communicating with the flowable product. The bag may be retained in a box, as known. The bag or bag-and-box, as the case may be, is simply placed inside the dispenser when needed, and the flowable product is dispensed from the bag, through the pump, generally by utilization of a hand-operated lever that appropriately contacts and compresses the necessary pump mechanisms and forces the flowable material out of a nozzle of the pump.

Of particular interest in this invention are dome pumps. In these pumps, an inlet and an outlet, both with appropriate valve mechanisms, communicate with a pump body, and a flexible dome extends over the body to retain the flowable product. When pressure is applied to the flexible dome causing the flexible dome to collapse, the inlet valve is closed and the outlet valve is opened, allowing product to be forced out of the outlet. As pressure is removed from the flexible dome, the outlet valve closes and the inlet valve opens to allow additional product to be drawn from the product source into the interior volume of the dome. Examples of dome pumps can be found in U.S. Pat. Nos. 3,486,663; 3,820,689; 3,987,938; 4,168,020; 5,207,355; 5,505,341; and 6,216,916. The prior art contains many other variations on this general theme.

The valves in the prior art dome pumps are often spring-biased ball valves, and it will be appreciated that such valve constructs involve multiple parts and manufacturing steps. Thus, some in the art have begun to construct valves from the dome itself. For example, the dome-type pump in U.S. Pat. Nos. 3,820,689 and 5,505,341 extend the dome to create both an inlet sealing flap that seals off the inlet port communicating with the interior of the dome and an outlet sealing flap that seals off the outlet port. As these prior art references show, there is need in the art for dome-type pump constructs that improve upon and reduce the complexity of the prior art designs by beneficially employing the dome portion (or compressible portion) as a valve.

Notably, the flexible dome portion of the dome pumps are often constructed from silicone. This is because silicone rubber is appropriately flexible and resilient, having a tendency to return to a molded shape, and tends not to swell or degrade in contact with various fluids, thus retaining its flexibility.

Silicone rubber is also readily made translucent, which has been found to be beneficial in dispenser arts employing dome pumps, as in U.S. Pat. No. 6,216,916. However, the silicone is unduly expensive, and a need exists for pumps that need not employ silicone.

Thus, there exists a need in the art for a pump that employs less expensive materials than the silicone typically employed; that is easy to manufacture, and reduces the necessary number of parts employed by employing the compressible portion thereof as a valve.

SUMMARY OF THE INVENTION

This invention generally provides what is termed herein a "bellows pump," because the main element that is manipulated to operate the pump (the compressible portion) includes structure similar to that of a camera bellows. The bellows pump includes a pump body having a base wall defined by a base wall perimeter. An inlet aperture is provided in the base wall, offset from the base wall perimeter, and an outlet aperture is also provided in the base wall, offset from the base wall perimeter. A bellows member is secured to the pump body and includes an open end defined by a sealing flange that is sealed to the base wall, with the inlet aperture and the outlet aperture being positioned within the open end. The bellows member further includes a sealing web extending inwardly from all points of the sealing flange to a first hinge, and a dosing web extending outwardly from the first hinge at one end thereof to a bellows cap at the other end thereof, the bellows cap creating a closed end opposite the open end. The sealing web, the dosing web and the bellows cap define a dose volume between the base wall of the pump body and the bellows cap, wherein pressing on the bellows cap toward the base wall collapses the bellows member such that the sealing web covers the inlet aperture but does not cover the outlet aperture, thereby expelling at least a portion of the contents of the dose volume out the outlet aperture.

In particularly preferred embodiments, the bellows member is formed of material other than silicone. Suitable materials have been found to be thermoplastic rubbers, ethylene-propylene-diene monomers (EPDMs), polyisoprenes, butyl rubbers, low density polyethylenes, and thermoplastic polyesters. A particular useful thermoplastic polyester is Hytrel™ (DuPont).

In particularly preferred embodiments, the pump body includes an outlet fitment and an inlet fitment and a spout fits over the outlet fitment and carries a valve that is retained by a valve retaining ring. A bellows retaining ring engages the bellows member and the pump body to seal the sealing flange to the base wall of the pump body. The pump body is formed in one piece, as is the bellows member, and the pump body, the bellows member, the bellows retaining ring, the spout, the valve and the valve retaining ring create the complete bellows pump. The bellows member may even be formed with the bellows retaining ring as one piece.

BRIEF DESCRIPTION OF DRAWINGS

For a complete understanding of the objects, techniques and structure of the invention, reference should be made to the following detailed description and accompanying drawings wherein.

DETAILED DESCRIPTION OF PREFERRED EMBODIMENTS

Figure 1:
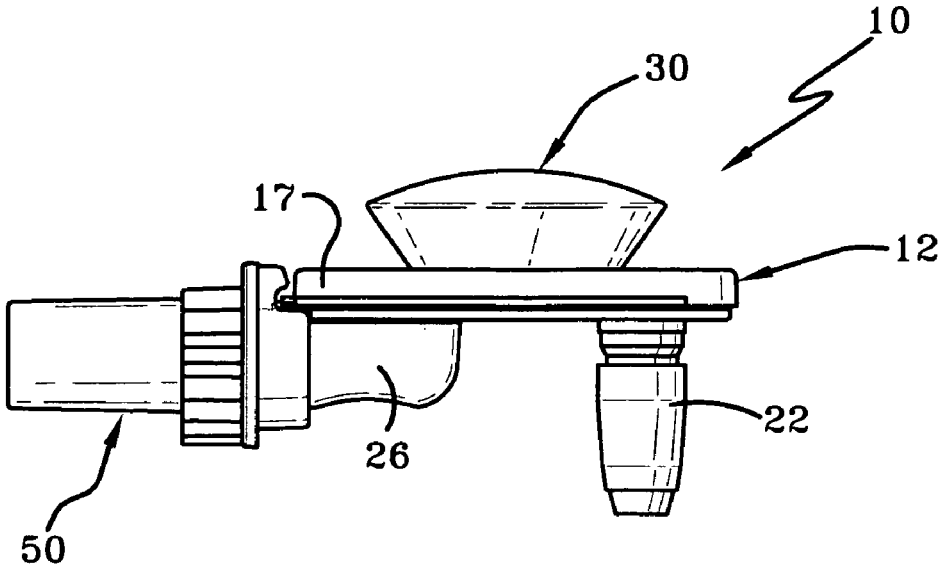
FIG. 1 is a side elevational view of a particularly preferred assembled bellows pump in accordance with the present invention.
Figure 2:
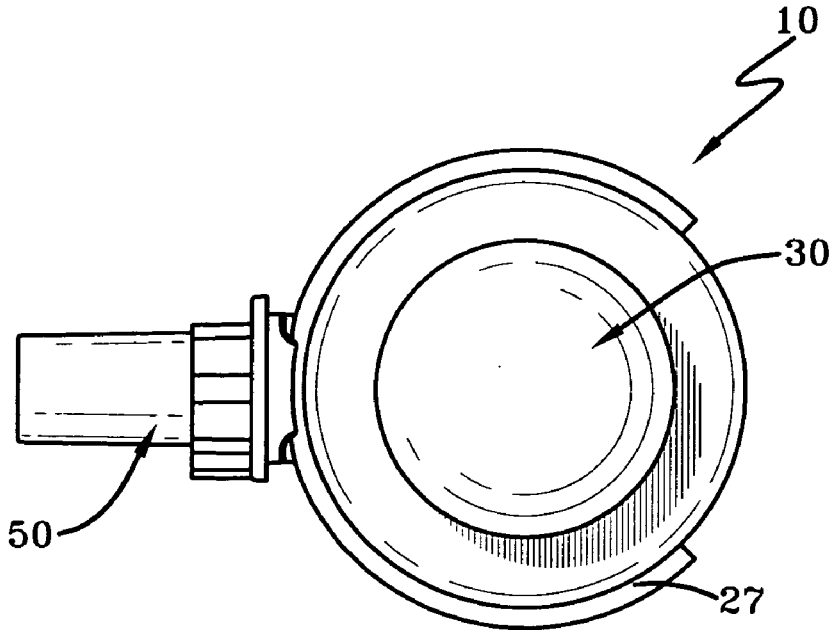
FIG. 2 is a top plan view of the bellows pump of FIG. 1.

With reference to FIGS. 1-4, it can be seen that a bellows pump in accordance with this invention is shown and designated by the numeral 10. Bellows pump 10 includes pump body 12 having base wall 14 defined by base wall perimeter 16. Perimeter wall 17 extends upwardly from base wall 14, at base wall perimeter 16, and provides means for securing bellows member 30 to pump body 12, as will be described more particularly below. Perimeter 16 is preferably circular, as shown. Inlet aperture 18 is provided in base wall 14 offset from base wall perimeter 16, and outlet aperture 20 is provided in base wall 14 and, for reasons that will be explained below, is offset from base wall perimeter 16 at a greater distance than inlet aperture 18. Inlet fitment 22 provides an inlet path 24 that communicates with inlet aperture 18. Similarly, outlet fitment 26 provides at least a portion of an outlet path 28 communicating with outlet aperture 20.

It will be appreciated that this specific construction providing inlet fitment 22 and outlet fitment 26, at substantially right angles, as shown in the figures, readily allows for the substitution of bellows pump 10 into combination bag and pump arrangements and dispensers employing the same. By way of representative example, a bellows pump in accordance with this invention may be employed in bag and pump arrangements and dispensers such as those shown in U.S. Pat. No. 6,216,916. Particularly, inlet fitment 22 may communicate with a bag that retains flowable product, and outlet fitment 26 may communicate with portions of dispensers made to employ such combination bag and pump arrangements. Flange 27 (FIG. 2) would communicate with a receiving member in such a dispenser, as known. Notably, the present disclosure focuses on disclosing a particular bellows pump configuration, and the incorporation of this configuration into bags and dispensers of the prior art will be readily apparent to those of ordinary skill in the art. Thus, such incorporation is not disclosed here as it would merely be repetitive of information already appreciated in the art.

Figure 4:
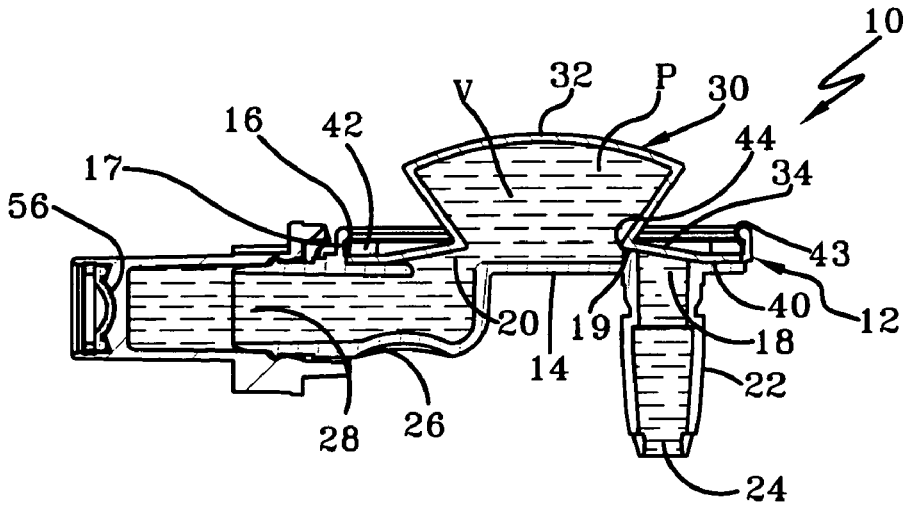
FIG. 4 is a cross-sectional view of the bellows pump, taken along the line 4-4 of FIG. 1, showing the bellows pump in a rest position.

Bellows member 30 fits over base wall 14 and serves as the actual pump mechanism. That is, the compression and expansion of bellows member 30 results in the dispensing of a dose of product and the loading of a new dose into the internal volume of bellows member 30. As seen in FIG. 4, the internal volume is designated by the letter V and is defined between base wall 14 and bellows cap 32. More particularly, volume V is defined by base wall 14, sealing web 34, dosing web 36 and bellows cap 32.

Figure 3:
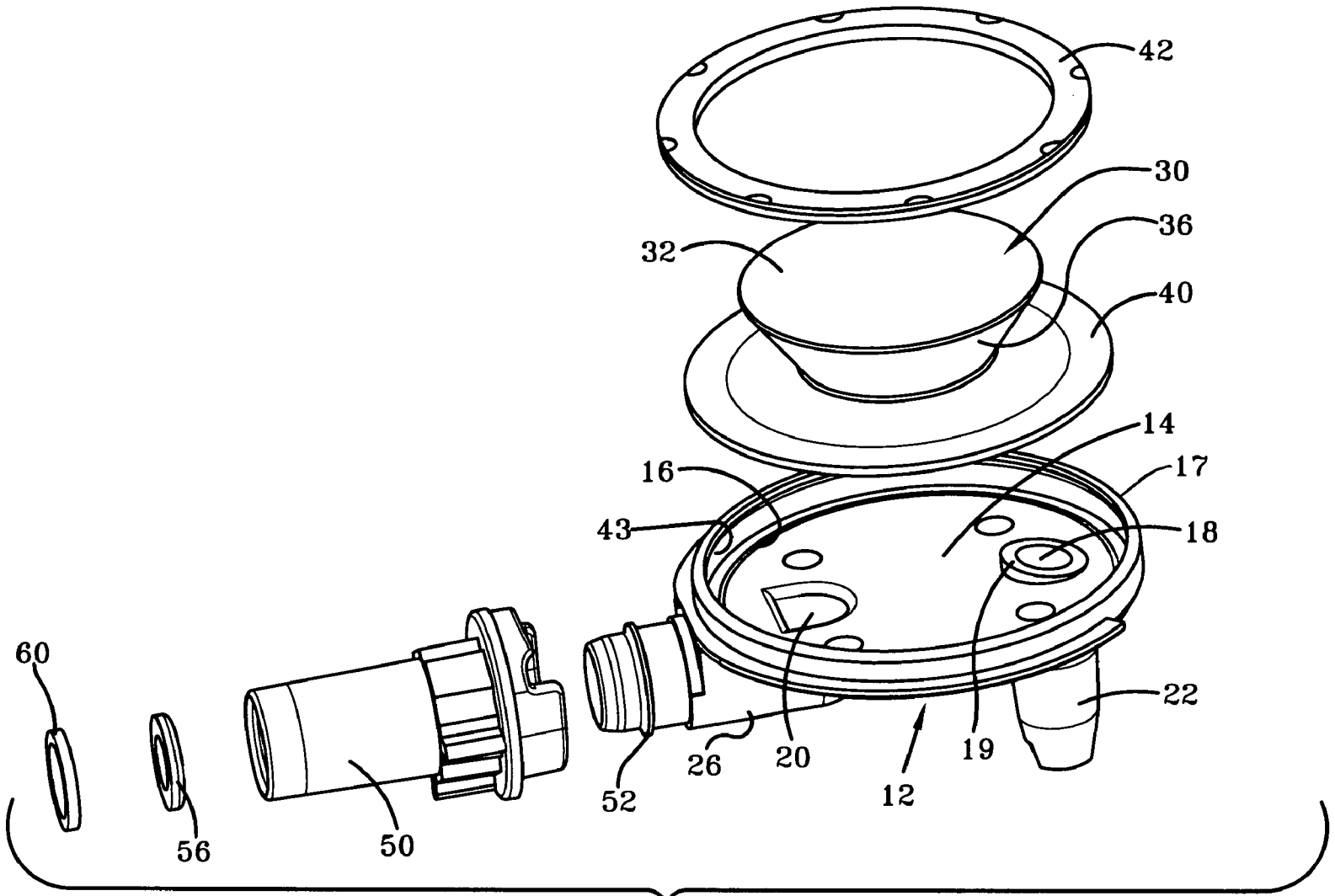
FIG. 3 is an assembly view showing the various elements of the bellows pump of FIG. 1.
Figure 7:
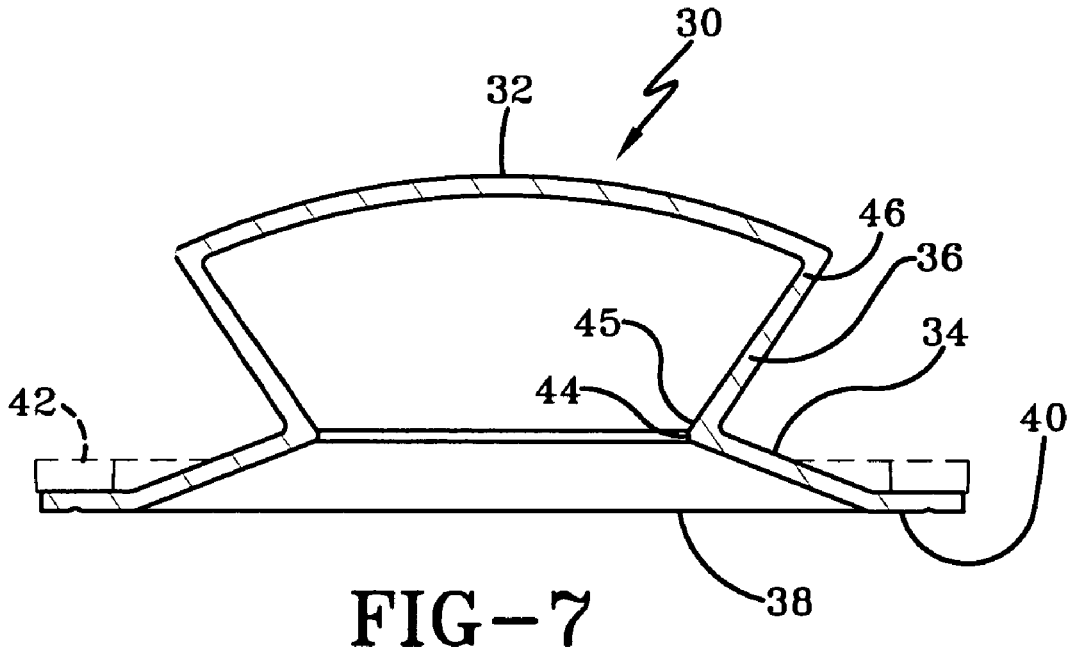
FIG. 7 is a cross-sectional view of the bellows member only.

Referring now to FIGS. 3, 4 and 7, it can be seen that bellows member 30 has an open end 38 defined by a sealing flange 40. Sealing flange 40 is sealed to base wall 14 by any suitable means, here by bellows retaining ring 42, which fits within channel 43 in perimeter wall 17 of pump body 12 to squeeze sealing flange 40 tightly against base wall 14. Bellows member 30 and bellows retaining ring 42 may even be formed as one piece to reduce the number of parts and aid in assembly (shown in phantom in FIG. 7). The force at which bellows retaining ring 42 forces sealing flange 40 against base wall 14 of pump body 12 is sufficient to ensure that product within bellows member 30 will not be able to exit bellows pump 10 between sealing flange 40 and base wall 14. It will be appreciated that other means for securing bellows member 30 to base wall 14 or another appropriate portion of pump body 12 may be employed, as, for example, employing an appropriate adhesive. Ultrasonic welding of sealing flange 40 to base wall 14 is also acceptable.

Sealing web 34 extends inwardly from all points of sealing flange 40 to first hinge 44. Dosing web 36 extends outwardly from first hinge 44 at a first end 45 thereof and joins with bellows cap 32 at a second end 46 to create a closed end opposite open end 38. Thus, when bellows member 30 is sealed to base wall 14 at sealing flange 40, bellows cap 32, sealing web 34, dosing web 36 and base wall 14 define a dose volume V. Bellows member 30 is preferably formed from a single, blow molded or injection molded piece, and, as mentioned, might be molded as one piece with bellows retaining ring 42.

Figure 5:
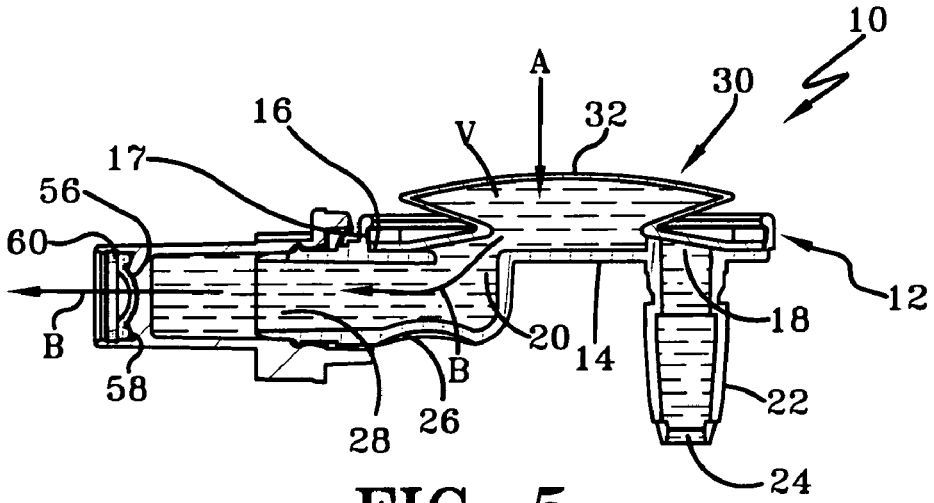
FIG. 5 is a cross-sectional view, as in FIG. 4, but shown as the bellows member is being compressed to dispense product.

In FIG. 4, bellows pump 10 is shown in its normal rest position, with sealing web 34 in contact with inlet aperture 18, and with flowable product P held within dose volume V. Product P is also present in outlet path 28 (from a previous dispensing of product) and in inlet path 24 (from an ultimate source of product P, e.g., a bag container of a bag and pump combination). Inlet aperture 18 has a contact surface 19 on a slope that substantially parallels the slope of sealing web 34 so that the contact between sealing web 34 and inlet aperture 18 will be flush and therefore not easily compromised to permit the flow of product P from within dose volume V through inlet path 24. Compressing bellows member 30 by pushing on bellows cap 32 in the direction of arrow A, as shown in FIG. 5, results in the dispensing of product P through outlet path 28, because sealing web 34 is in contact with inlet aperture 18 and seals the same against the flow of product P from within dosage volume V. Sealing web 34 does not cover outlet aperture 20 upon compression of bellows member 30 and, thus, product P is forced through outlet aperture (i.e., dispensed) in the direction of arrow B, going through elastomeric valve 56 in a spout 50, disclosed more particularly herein below. In the embodiment shown, sealing web 34 cannot cover all of outlet aperture 20 because it is inset from perimeter 16 at a greater distance than is inlet aperture 18.

Figure 6:
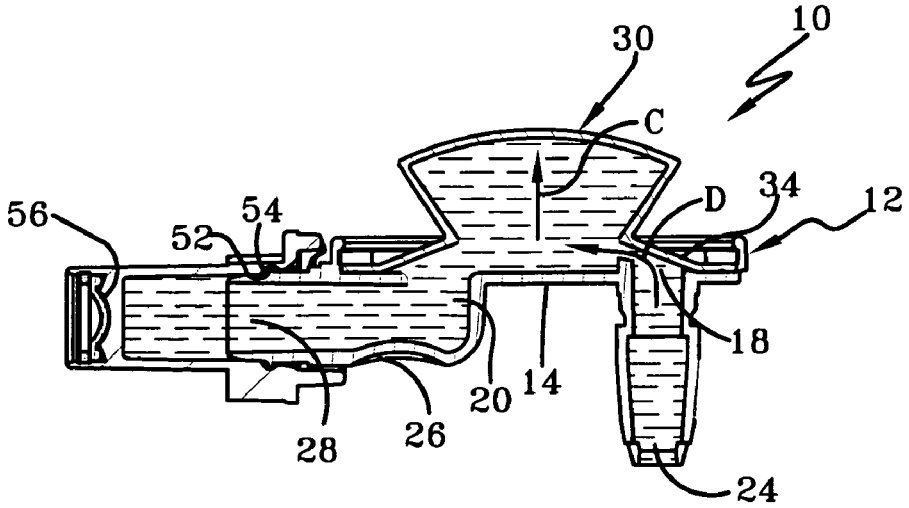
FIG. 6 is a cross-sectional view, as in FIGS. 4 and 5, but shown as the bellows member expands to draw product into the pump.

With reference to FIG. 6, expansion of bellows member 30, as represented by arrow C, draws product in through inlet aperture 18, as at arrow D. This is due to the resilient nature of the materials selected for forming bellows member 30. That is, the force at which bellows member 30 expands back to its normal rest position of FIG. 4 is sufficient to pull product P into dose volume V, forcing sealing web 34 off of its normal resting position closing off inlet aperture 18.

Although it will be appreciated that appropriate valving could be employed in outlet fitment 26 to permit for only the dispensing of product P from dose volume V and prohibit the pulling of product P through outlet fitment 26 into dose volume V, the preferred embodiment of the present invention employs valve mechanisms in a separate spout element, namely spout 50. As seen in FIGS. 1-5, spout 50 fits over outlet fitment 26 and is secured thereto particularly through the interaction of rib 52 (on outlet fitment 26) and channel 54

(in spout 50). With reference to FIGS. 4-6, it can be seen that elastomeric valve 56 is retained in spout 50, at step 58, by valve retaining ring 60, which fits in channel 62 adjacent step 58. Elastomeric valve 56 is a basic one-way valve made from elastomers. It opens to permit flow in the direction of arrow B, when sufficient pressure is applied to bellows member 30 (as in FIG. 5), but is normally biased to be closed and prevent flow in the direction opposite arrow B upon an expansion of bellows member 30 from a compressed state (as in FIG. 6).

Pump body 12, including inlet fitment 22 and outlet fitment 26, is preferably formed from lightweight, rigid materials. Many plastics are suitable, such as polypropylene, polyethylene, acetal or acrylonitrile butadiene styrene (ABS). Spout 50 is also preferably formed from such materials.

Bellows member 30 is preferably formed from resilient, flexible materials, particularly those capable of returning the bellows member from its compressed state to its rest state thousands of times, without seriously compromising the integrity of the bellows member. Preferably, the entire bellows member 30 is formed from the same material to simplify manufacturing, but it is contemplated that certain portions might be formed from one material while other portions are formed from different materials. Silicone rubber may be employed for bellows member 30, but is preferably avoided due to costs. Broadly, elastomeric rubbers are preferred.

In some embodiments, bellows member 30 is formed from materials selected from the group consisting of polyvinly chloride (PVC), thermoplastic rubbers, EPDMs, polyisoprenes, butyl rubbers, and low density polyethylenes (LDPEs) and thermoplastic polyesters. A particular useful thermoplastic polyester is Hytrel™ (DuPont).

When sealing flange 40 is to be secured by bellows retaining ring 42, sealing flange 40 is preferably made of readily compressible elastomeric material. The EPDM, polyisoprene and butyl rubber materials would be suitable. Trefsin™ (a thermoplastic rubber from Advanced Elastomer Systems, grade number 3271-65W308) is particularly useful because it is resistant to soaps.

If sealing flange 40 is ultrasonically welded to base wall 14, low density polyethylene could be employed for sealing flange 40 and the remainder of bellows member 30. Engage™, a LDPE from DuPont Dow Elastomers, ethylene-octene copolymer, is suitable, and is transparent, flexible and durable.

Having illustrated and described the principles of this invention in a preferred embodiment thereof, it should be readily apparent to those skilled in the art that the invention can be modified in arrangement and detail without departing from such principles. Accordingly, for an appreciation of the true scope of the invention, reference should be made to the accompanying claims.

What is claimed is:

1. A bellows pump comprising:

a pump body having a base wall defined by a base wall perimeter;

an inlet aperture in said base wall offset from said base wall perimeter;

an outlet aperture in said base wall offset from said base wall perimeter; and a bellows member including:

an open end defined by a sealing flange that is sealed to said base wall, with said inlet aperture and said outlet aperture being positioned within said open end, a first hinge, a sealing web extending inwardly from all points of said sealing flange to said first hinge, a bellows cap, and a dosing web extending outwardly from said first hinge at one end of said dosing web to said bellows cap at the other end of said dosing web, wherein said bellows cap provides a closed end opposite said open end, said sealing web, said dosing web and said bellows cap defining a dose volume between said base wall of said pump body and said bellows cap, wherein pressing on said bellows cap toward said base wall collapses said bellows member such that said sealing web covers said inlet aperture but does not cover said outlet aperture, thereby expelling at least a portion of the contents of said dose volume out said outlet aperture.

2. The bellows pump of claim 1 wherein said pump body further comprises an outlet fitment providing at least a portion of an outlet path communicating with said outlet aperture.

3. The bellows pump of claim 2 wherein said pump body further comprises an inlet fitment providing an inlet path communicating with said inlet aperture.

4. The bellows pump of claim 3 wherein a spout is secured to said outlet fitment and provides an extension of said outlet path provided by said outlet fitment, the bellows pump further comprising a valve in said extension of said outlet path provided in said spout.

5. The bellows pump of claim 4 wherein said spout is secured to said outlet fitment through the interaction of a rib and channel.

6. The bellows pump of claim 4 further comprising a bellows retaining ring engaging said bellows member and said pump body to seal said sealing flange to said base wall, and a valve retaining ring engaging said valve and said spout to seal said valve within said extension of said outlet path, wherein said pump body is formed in one piece, and said bellows member is formed in one piece, with said pump body, said bellows member, said bellows retaining ring, said spout, said valve and said valve retaining ring creating the complete bellows pump.

* * * * *